US009540925B2

(12) United States Patent
Massam et al.

(10) Patent No.: US 9,540,925 B2
(45) Date of Patent: Jan. 10, 2017

(54) METHODS AND SYSTEMS OF INCREASING SIGNAL STRENGTH OF OILFIELD TOOLS

(71) Applicant: M-I Drilling Fluids U.K. Ltd., Aberdeen (GB)

(72) Inventors: Jarrod Massam, Aberdeen (GB); Ramy Mahrous, Houston, TX (US); Sandra Reyes, Gloucester (GB)

(73) Assignee: M-I Drilling Fluids UK Ltd., Aberdeen, Scotland (GB)

( * ) Notice: Subject to any disclaimer, the term of this patent is extended or adjusted under 35 U.S.C. 154(b) by 49 days.

(21) Appl. No.: 14/408,499

(22) PCT Filed: Jun. 18, 2013

(86) PCT No.: PCT/US2013/046242
§ 371 (c)(1),
(2) Date: Dec. 16, 2014

(87) PCT Pub. No.: WO2013/192139
PCT Pub. Date: Dec. 27, 2013

(65) Prior Publication Data

US 2015/0204188 A1 Jul. 23, 2015

Related U.S. Application Data

(60) Provisional application No. 61/661,277, filed on Jun. 18, 2012.

(51) Int. Cl.

| | |
|---|---|
| ***G01V 3/00*** | (2006.01) |
| ***E21B 47/18*** | (2012.01) |
| ***E21B 49/00*** | (2006.01) |

(52) U.S. Cl.
CPC ..... *E21B 47/18* (2013.01); *E21B 47/182* (2013.01); *E21B 47/185* (2013.01); *E21B 47/187* (2013.01); *E21B 49/00* (2013.01)

(58) Field of Classification Search
CPC ..... E21B 47/18
USPC ..... 340/854.3
See application file for complete search history.

(56) References Cited

U.S. PATENT DOCUMENTS

| | | | | |
|---|---|---|---|---|
| 3,309,656 | A | 3/1967 | Godbey | |
| 3,764,968 | A | 10/1973 | Anderson | |
| 3,764,969 | A | 10/1973 | Cubberly, Jr. | |
| 3,764,970 | A | 10/1973 | Manning | |
| 4,468,381 | A * | 8/1984 | Mitra | A61K 9/0095 424/689 |
| 6,219,301 | B1 | 4/2001 | Moriarty | |
| 6,335,102 | B1 * | 1/2002 | Tsubaki | B32B 29/00 162/125 |

(Continued)

FOREIGN PATENT DOCUMENTS

WO 2008/033838 A2 3/2008

OTHER PUBLICATIONS

International Search Report and Written Opinion from corresponding PCT Application Serial No. PCT/US2013/046242 dated Sep. 6, 2013, 19 pages.

*Primary Examiner* — Santiago Garcia
(74) *Attorney, Agent, or Firm* — Sara K. M. Hinkley

(57) ABSTRACT

A method for measuring at least one property of an earth formation and transmitting information through the earth formation may include positioning at least one sensor downhole, circulating a wellbore fluid downhole, and transmitting a first signal from the sensor to at least one modulator.

24 Claims, 7 Drawing Sheets

(56) References Cited

U.S. PATENT DOCUMENTS 6,741,185 B2 * 5/2004 Shi ..... G01V 11/002 175/40
7,180,826 B2 * 2/2007 Kusko ..... E21B 47/187 175/45
8,168,569 B2 * 5/2012 Ballard ..... C09K 8/03 166/305.1
8,598,096 B2 * 12/2013 Ballard ..... C09K 8/03 166/305.1
2003/0151978 A1 * 8/2003 Jeffryes ..... E21B 47/18 367/83
2007/0194947 A1 * 8/2007 Huang ..... E21B 47/14 340/854.3
2008/0002524 A1 * 1/2008 Wassermann ..... E21B 47/18 367/83
2008/0024319 A1 * 1/2008 Close ..... E21B 47/18 340/854.3
2008/0064613 A1 3/2008 Massam
2008/0169130 A1 * 7/2008 Norman ..... C09K 8/05 175/65
2009/0005271 A1 * 1/2009 Massam ..... C09K 8/032 507/140
2009/0285054 A1 * 11/2009 Song ..... E21B 47/182 367/84
2010/0009874 A1 * 1/2010 Ballard ..... C09K 8/03 507/118
2010/0013663 A1 * 1/2010 Cavender ..... G01V 11/002 340/854.3
2010/0067329 A1 3/2010 Edwards et al.
2010/0171639 A1 * 7/2010 Clark ..... E21B 47/12 340/856.3
2011/0018734 A1 * 1/2011 Varveropoulos ..... G01V 11/002 340/853.7
2012/0086456 A1 4/2012 Kumar
2012/0186880 A1 7/2012 Patel et al.
2012/0199397 A1 * 8/2012 Wessling ..... E21B 47/06 175/57
2014/0162909 A1 * 6/2014 Ballard ..... C09K 8/03 507/116

* cited by examiner

METHODS AND SYSTEMS OF INCREASING SIGNAL STRENGTH OF OILFIELD TOOLS

BACKGROUND

Drilling operations often employ a number of techniques to gather information such as the depth and inclination of a borehole and the types of rocks through which a drill pipe and drill bit are drilling. For this purpose, techniques called Logging-While-Drilling (LWD) and Measurement-While-Drilling (MWD) were developed in the oil exploration and production industry, which enable the collection of data in real-time. LWD collects logging information similar to the conventional wireline logging, while MWD also enables a driller to determine the position and orientation of the drill bit and direction of a borehole during the drilling operation so that the driller can more accurately control the drilling operations.

MWD permits data to be transmitted in complex wells, such as directional and horizontal drills. MWD is achieved by incorporating MWD tools into a module in the steering tool of the drill string. These MWD tools collect real time drilling information, and transmit this data as pulses through the mud column. This data is transmitted to the surface and can be used for real-time data acquisition, geosteering, and formation evaluation.

Common to MWD techniques is the problem of transmitting data from the bottom of a borehole to a point on the surface where it can be collected and processed. One technique for this type of data transmission is mud pulse telemetry. During the drilling operation, drilling mud is pumped from a mud pump downward through the drill pipe and emerges near the drill bit at the bottom of the drill hole. This mud cools and lubricates the drill bit, carries rock cuttings to the surface where they can be analyzed and prevents the walls of the borehole from collapsing.

In mud pulse telemetry, a transmission device, or "pulser," such as an electro-mechanical pulser or a mud siren near the drill bit generates an acoustic signal that is transmitted upward to the surface through the downward traveling column of mud. Modern mud sirens, for example, are capable of generating a carrier pressure wave of 12 Hz. A transducer, generally at the surface, receives the signal and transmits it to a signal processor. The signal processor then decodes and analyzes the signal to provide information about the drilling operation to the driller.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to methods for measuring at least one property of an earth formation and transmitting information through the earth formation, where the method includes positioning at least one sensor downhole; circulating a wellbore fluid downhole, where the wellbore fluid has a viscometer reading of less than 5, measured at 6 and 3 rpm; and transmitting a first signal from the sensor to at least one modulator.

In another aspect, embodiments disclosed herein relate to methods of designing a drilling system, where the methods include selecting a fluid system to have a viscometer reading of less than 8, measured at 6 and 3 rpm; selecting a MWD tool and a gap between a rotor and stator, where the selection of the fluid system and selection of the MWD tool and the gap is made based upon the selection of the other; assembling a drilling system with the selected MWD and gap; and circulating the selected fluid system through the drilling system while drilling a wellbore through an earth formation.

In another aspect, embodiments disclose herein related to a downhole measurement while drilling system, where the system includes at least one sensor at a drill string locatable downhole during a well operation; and a communication medium at the drilling string capable of transmitting sensed data between the sensor and a surface processor, where the communication medium has a viscometer reading of less than about 5, measured at 6 and 3 rpm, and where the communication medium includes at least a base fluid and a weighting agent having a $d_{50}$ less than 25 microns.

Other aspects and advantages of the claimed subject matter will be apparent from the following description and the appended claims.

DETAILED DESCRIPTION

In one aspect, embodiments disclosed herein relate to systems and methods for transmitting data from a downhole tool, and in particular, to selection of the medium through which the data is transmitting. Thus, embodiments of the present disclosure relate to designing a system in which the MWD tool (and signals therefrom) may be optimized. Such optimization may include increasing signal strength, tool modification, etc., based on fluid selection.

Figure 1:
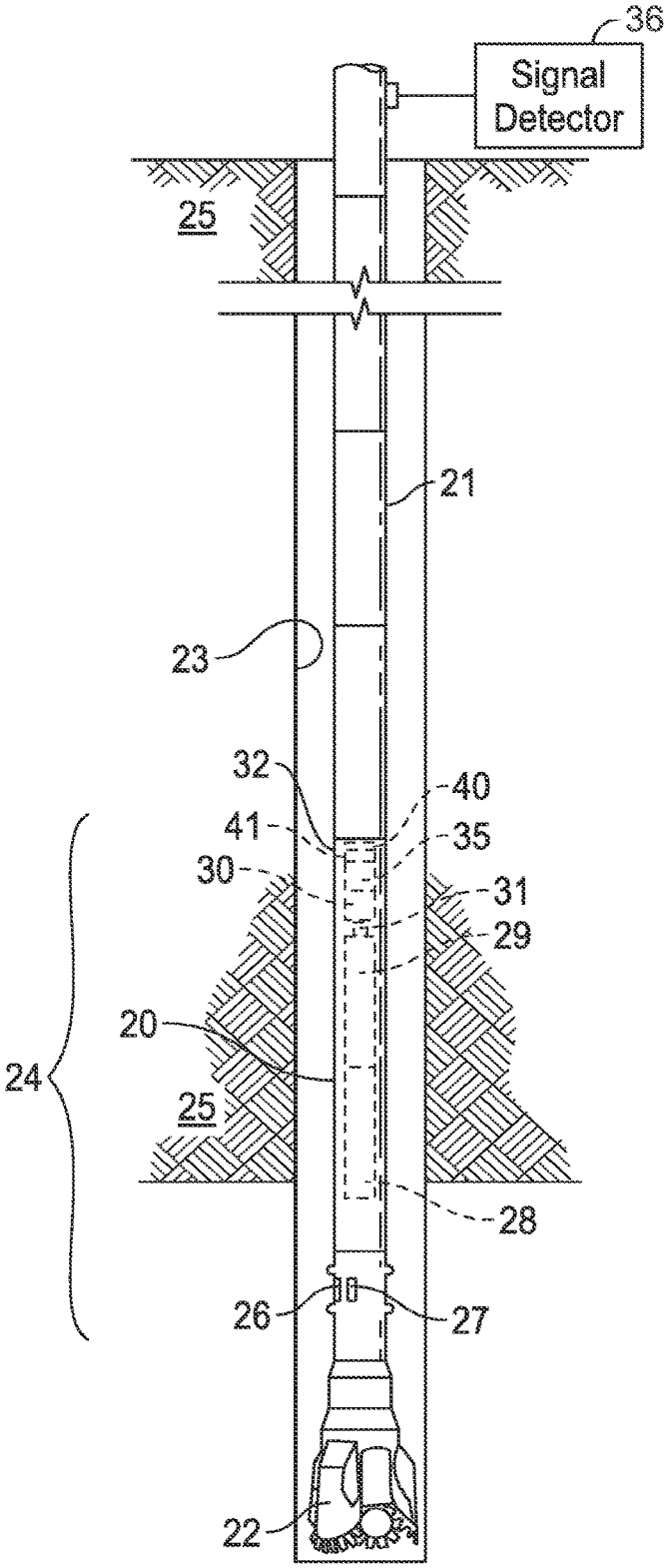
FIG. 1 shows a system for mud pulse telemetry during drilling operations.

FIG. 1 shows a tubular MWD tool 20 connected in a tubular drill string 21 having a rotary drill bit 22 coupled to the end thereof and arranged for drilling a borehole 23 through earth formations 25. As the drill string 21 is rotated by a conventional drilling rig (not shown) at the formation surface, substantial volumes of a suitable drilling fluid (ie "drilling mud") are continuously pumped down through the drill string 21 and discharged from the drill bit 22 to cool an lubricate the bit and to carry away earth cuttings removed by the bit. The mud is returned to the top of the borehole along the annular space existing between the walls of the borehole 23 and the exterior of the drill string 21. The circulating mud stream flowing through the drill string 21 may serve, if desired, as a medium for transmitting pressure pulse signals carrying information from the MWD tool 20 to the formation surface.

A downhole data signal unit 24 has transducers mounted on the tool 20 that take the form of one or more condition responsive devices 26 and 27 coupled to appropriate circuitry, such as encoder 28, which sequentially produces encoded digital data electrical signals representative of the measurements obtained by the transducers 26 and 27. The transducers 26 and 27 are selected and adapted as required for the particular application to measure such downhole parameters as the downhole pressure, the downhole temperature and the resistivity or conductivity of the drilling mud or adjacent earth formations, as well as to measure various other downhole conditions similar to those obtained by present day wireline logging tools.

Electrical power for operation of the data signaling unit 24 is provided by a typical rotatably-driven axial flow mud turbine 29 which has an impeller 30 responsive to the flow of drilling mud that drives a shaft 31 to produce electrical energy.

The data signaling unit 24 also includes a modulator 32 which is driven by a motor 35 to selectively interrupt or obstruct the flow of the drilling mud through the drill string 21 in order to produce digitally encoded pressure pulses in the form of acoustic signals. The modulator 32 is selectively operated in response to the data encoded electrical output of the encoder 28 to generate a correspondingly encoded acoustic signal. This signal is transmitted to the well surface by way of the fluid flowing in the drill string 21 as a series of pressure pulse signals which preferably are encoded binary representations of measurement data indicative of the downhole drilling parameters and formation conditions sensed by transducers 26 and 27. When these signals reach the surface, they are detected, decoded and converted into meaningful data by a suitable signal detector 36, such as shown in U.S. Pat. Nos. 3,309,656; 3,764,968; 3,764,969; and 3,764,970 and acquisition system. Telemetry transmissions from downhole data signaling unit 24 may include data sent as it is collected ("continuous" or "real-time" data), data stored and transmitted after a delay ("buffered" or "historical" data), or a combination of both.

The modulator 32 includes a fixed stator 40 and a rotatable rotor 41 (though, the reverse may instead be used) which is driven by the motor 35 in response to signals generated by the encoder 28. Rotation of the rotor 41 is controlled in response to the data encoded electrical output of the encoder 28 in order to produce a correspondingly encoded acoustic output signal. This can be accomplished by applying well-known techniques to vary the direction or speed of the motor 35 or to controllably couple/uncouple the rotor 41 from the drive shaft of the motor 35.

The stator 40 has a plurality of evenly-spaced block-like lobes (not shown) circumferentially arranged about a central hub. The gaps between adjacent lobes (not shown) provide a plurality of ports in the stator through which incident drilling mud may pass as jets or streams directed more or less parallel to the stator hub axis. Also, as will be described in greater detail hereinafter, the rotor 41 has a similar configuration to that of the stator. The rotor 41 may be positioned coaxial to and adjacent to the stator 40 such that the rotor may rotate about an axis coaxial with the hub axis of the stator. As the rotor 41 is rotated, its lobes (not shown) successively move into and out of positions obstructing the flow of the drilling mud through the ports of the stator. In this manner, pressure pulse signals are produced and transmitted upstream in the circulating mud.

When the rotor 41 is rotated to the stator 40 so as to momentarily present the greatest flow obstruction to the circulating mud stream, the resulting acoustic signal will be at its maximum amplitude. As the rotor 41 continues to rotate, the amplitude of the acoustic signal produced by the modulator 32 will decrease from its maximum to its minimum value as the rotor moves to a position in which it presents the least obstruction to the mud flow. Further rotor rotation will cause a corresponding increase in signal amplitude as the rotor again approaches its next maximum flow obstruction position.

Rotation of the modulator rotor 41 will produce an acoustic output signal having a cyclic waveform with successively alternating positive and negative peaks referenced about a mean pressure level. Continuous rotation of the rotor 41 will produce a typical alternating or cyclic signal at a designated frequency which will have a determinable phase relationship in relation to some other alternating signal, such as a selected reference signal generated in the circuitry of the signal detector 36. By momentarily advancing, retarding, stopping or reversing the rotation of the rotor 41 in response to outputs from the encoder 28, the rotor can be selectively shifted to a different position vis-a-vis the stator 40 than it would have occupied had it continued to rotate without change. This selective shifting causes the phase of the acoustic signal to shift relative to the phase of the reference signal. Such controlled phase shifting of the signal generated by the modulator 32 acts to transmit downhole measurement information by way of the mud column to the borehole surface or detection by the signal detector 36. A shift in phase at a particular instance signifies a binary bit "1" (or "0", as desired) and absence of a shift signifies a binary bit "0" (or "1"). Other signal modulation techniques are usable, and selection of the specific encoding, modulation and decoding schemes to be employed in connection with the operation of the modulator 32 are matters of choice.

Thus, in one or more embodiments, a MWD tool uses a modulator to generate a small pressure variation in the mud flow creating binary codes that will be received by a signal pressure transducer (SPT) and turned into data by the acquisition system. The signal bandwidth is determined by programming the MWD tool based mainly on expected logging speed and signal strength. The center of this bandwidth will generally be the carrier frequency, where the transmitted signal varies from 0.5 Hz up to 24 Hz; the faster the transmission rate, the higher the frequency needs to be, as well as the bandwidth gets bigger. The signal generated by the modulator may attenuate as the depth of the tool increases, and as the viscosity of the mud increases. Moreover, the only known manners of increasing signal strength are by increasing mud flow through the modulator, decreasing the flow area through the modulator, or by increasing mud density. Thus, it will be appreciated that the only known manner of increasing signal strength which may be affected by modulator flow design is to decrease the flow area of the modulator by reducing the modulator gap. However, reducing the modulator gap makes the modulator susceptible to jamming as circulation materials can become jammed between the rotor and stator. Jamming is costly as it typically stops the modulator rotation in the fully closed position, thereby preventing circulation through the MWD tool and necessitating the removal of the tool from the borehole. Therefore, achieving stronger signal strength with the correct drilling fluid system is crucial to increase the overall signal-to-noise ratio. The acquisition system is programmed to encode and process all the data in a specific bandwidth. The drilling fluid is one of the main concerns when evaluating the signal strength of a downhole tool.

Figure 2:
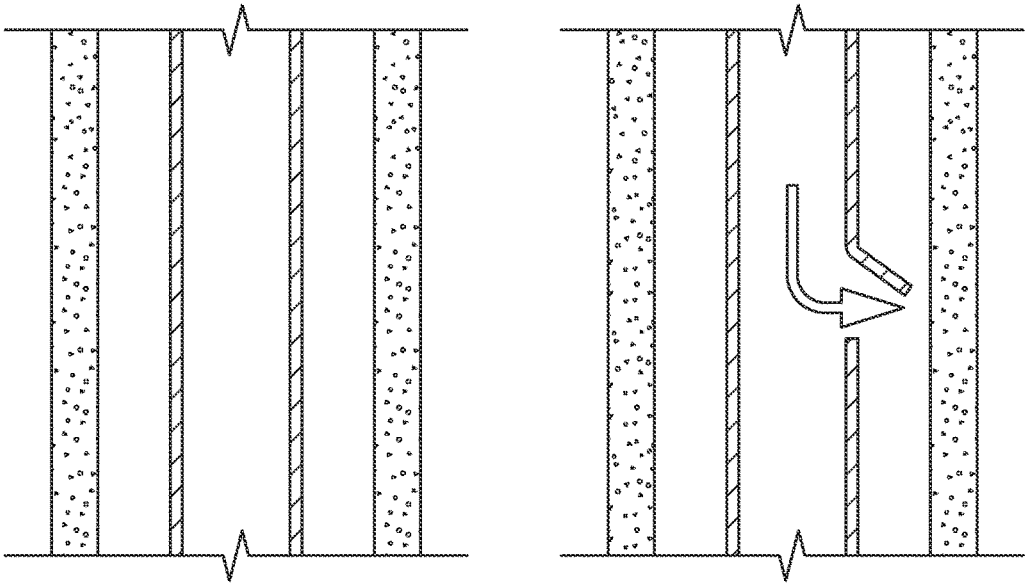
FIG. 2 shows a depiction of Negative Pulses.
Figure 3:
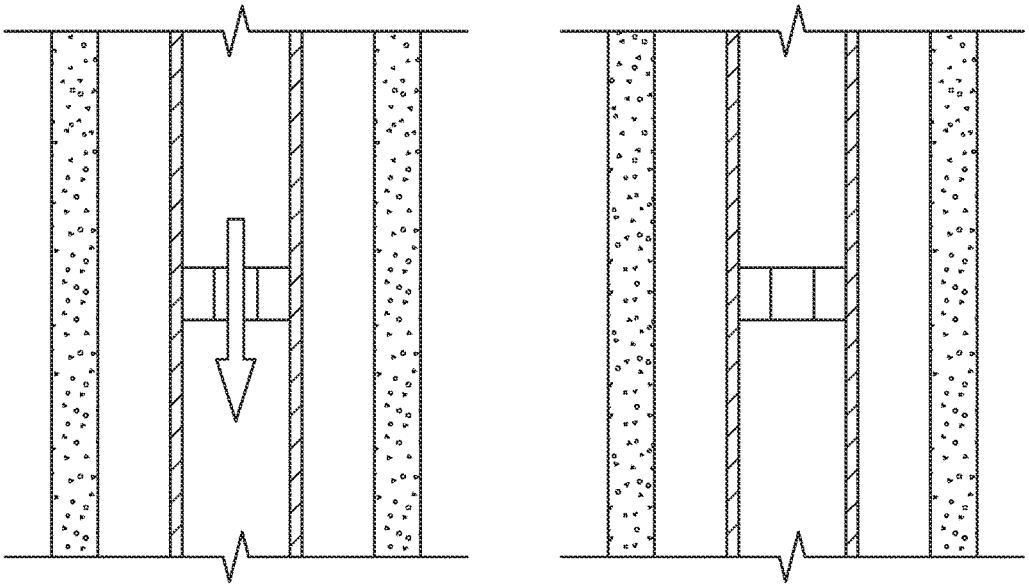
FIG. 3 shows a depiction of Positive Pulses.
Figure 4:
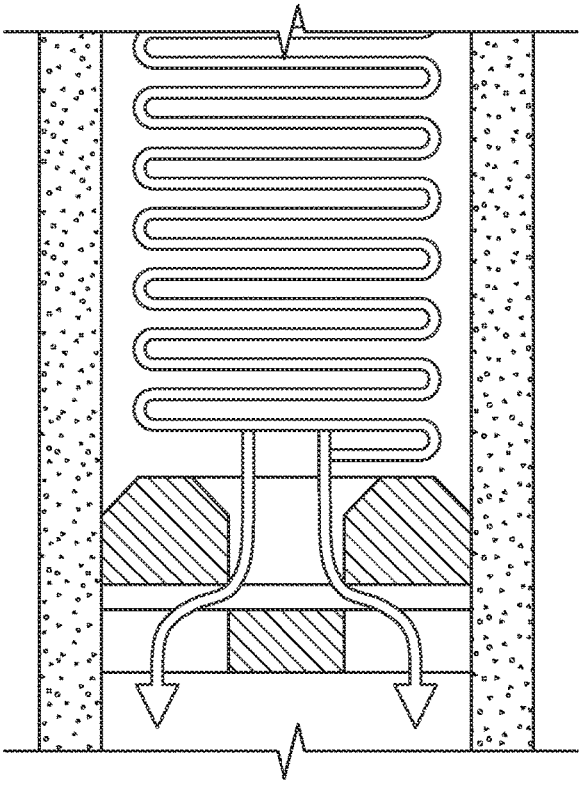
FIG. 4 shows a depiction of Continuous Pulses.

There are three principal ways to show how the signal generation is made: positive pulses, negative pulses and continuous pulses. Whenever a given pressure is achieved, and the modulator starts working, it opens a connection between the drill string and the annulus, generating a decrease in pressure within the drill string, thus generating a pulse. This is depicted in FIG. 2, showing the negative pulses. Referring to FIG. 3, positive pulses are generated by a valve that closes the mud flow, thus generating an increase in pressure within the drill string, which generates the pressure pulses. In continuous pulses, as depicted in FIG. 4, the modulator has a rotor and a stator, the stator rotates in a motion that slowly closes/open the drillstring, the pressure increases and decreases in a sinusoidal wave, thus generating the pulses.

Figure 5:
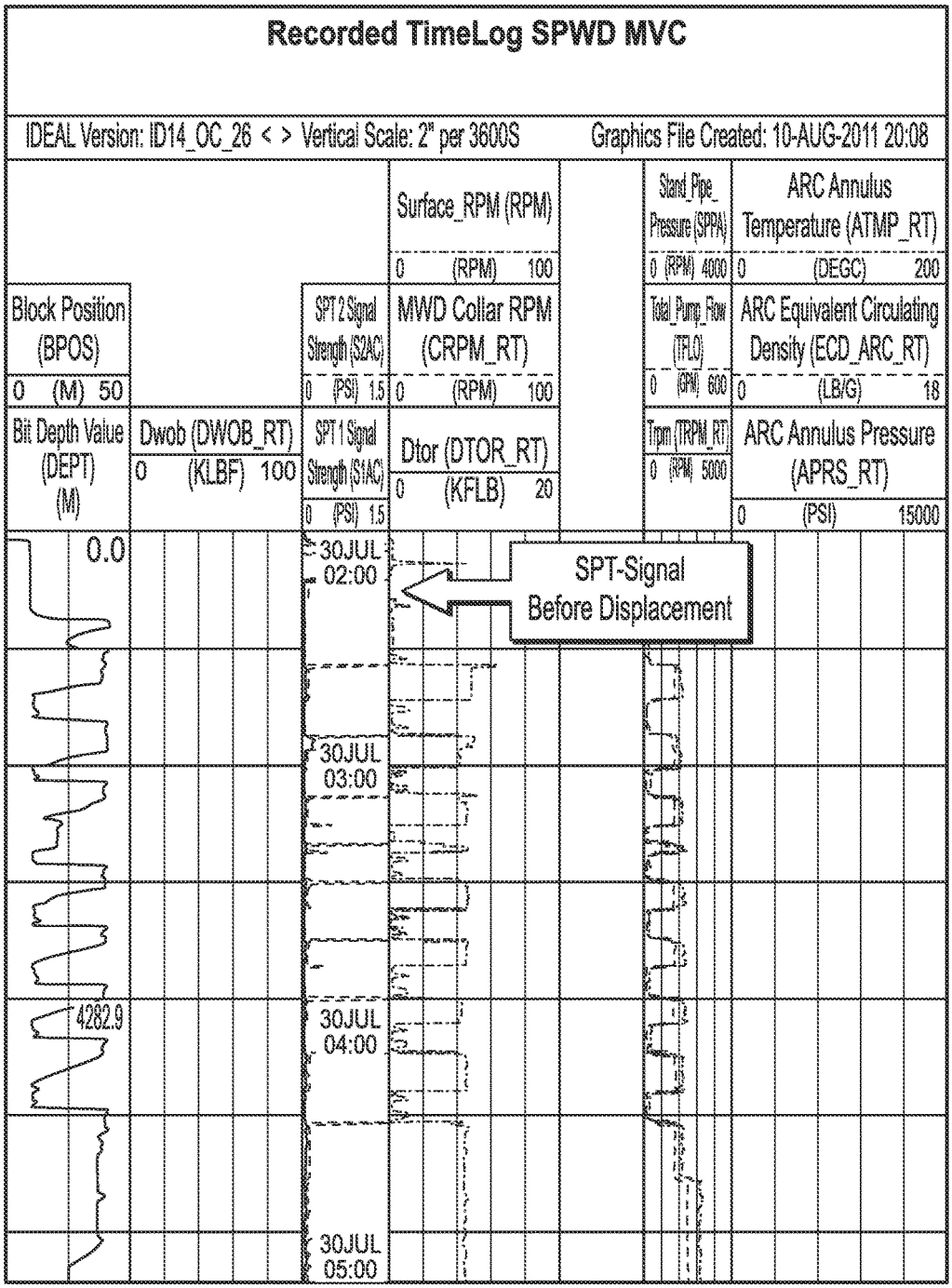
FIGS. 5-7 are time logs depicting signal strength changes as a synthetic based fluid is displaced with an oil based fluid containing micronized weighting agents.
Figure 6:
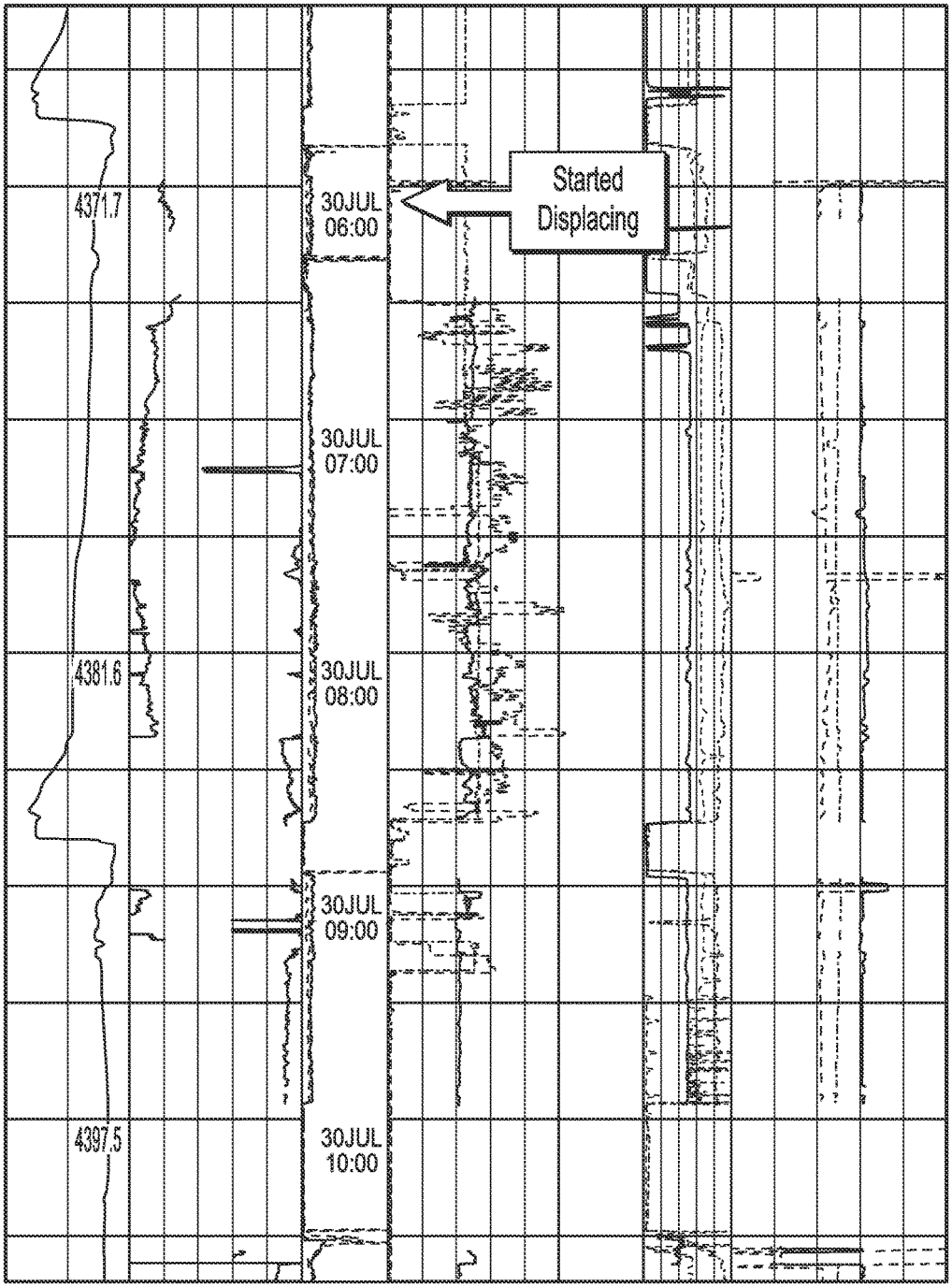
Figure 7:
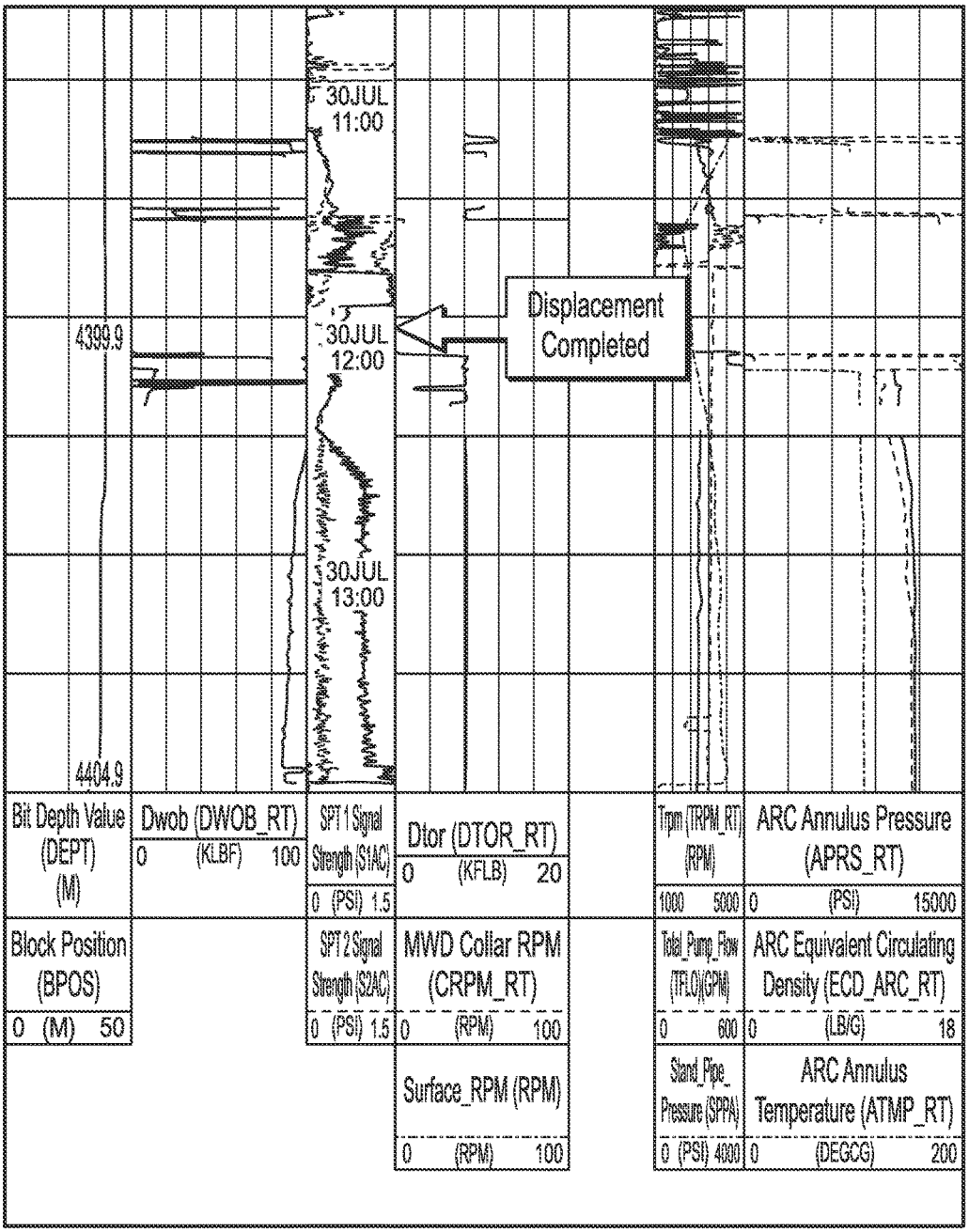
Figure 8:
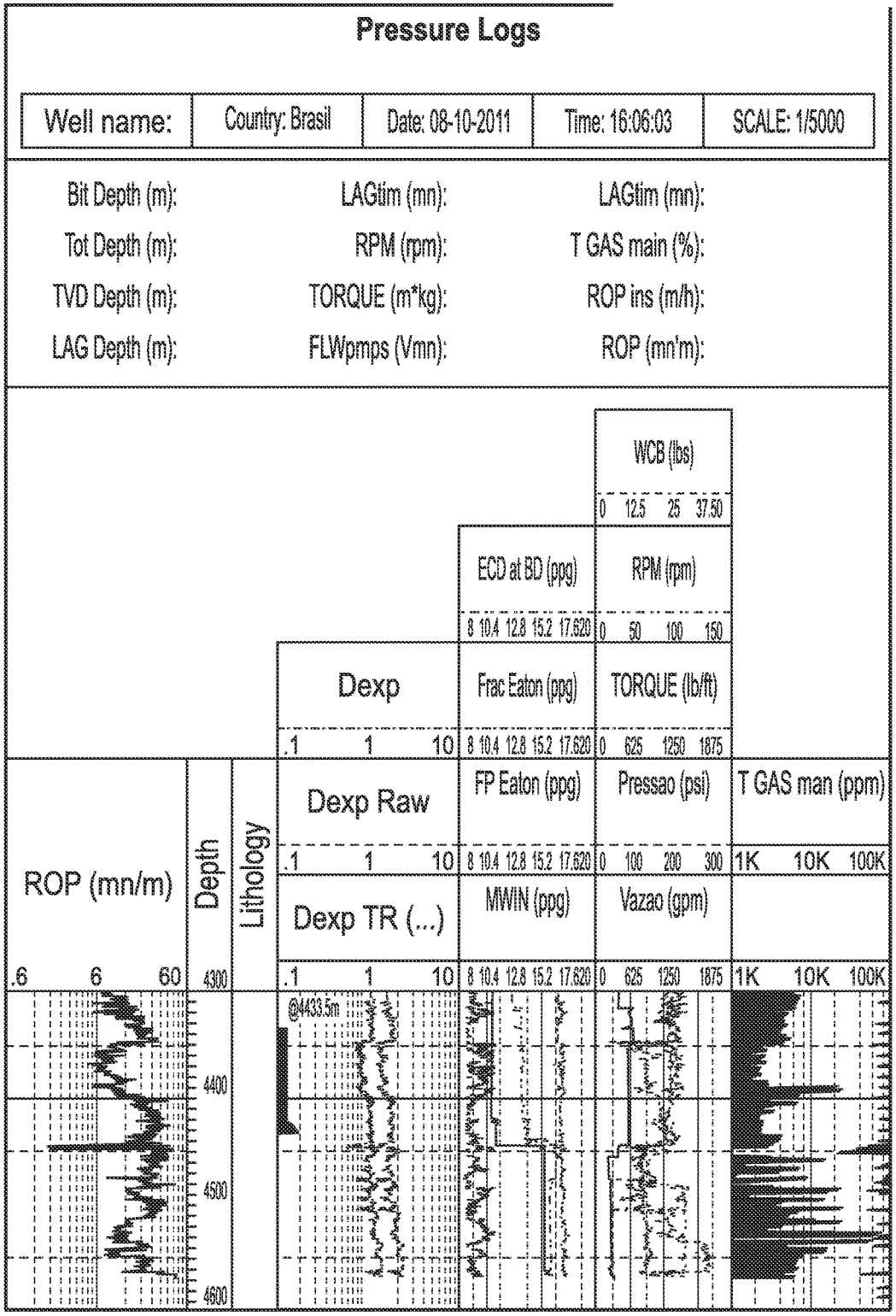
FIG. 8 is the Pressure Logs showing the reduction in torque from 12500 lb. ft to 6250 lb. ft when displacing the synthetic based fluid with an oil based fluid containing micronized weighting agents.

Other than the drilling related issues, the MWD faces a difficulty in that the deeper the well, the weaker the signal strength of the tool. Mud type also affects the received-signal amplitude and width. In general, oil-based muds (OBMs) and pseudo-oil-based muds are more compressible than water-based muds; therefore, they result in the greatest signal losses. However, when selecting a drilling system (including drilling fluid) in accordance with the embodiments of the present disclosure, an increase in the MWD signal strength may be achieved. For example, as illustrated in FIGS. 5-7, a ten-fold increase in signal strength from 0.1-0.2 psi to 1-2 psi were found without any signal distortions when a drilling fluid having a desirable low end rheology was used. Adding to that, 50% torque reduction was recorded from 12500 to 6250 lb.ft when the wellbore was displaced from a conventional oil-based fluid to an oil-based fluid having reduced low end rheology (with micronized weighting agents), as illustrated in FIG. 8.

Thus, embodiments of the present disclosure may involve methods of measuring a property of an earth formation, the wellbore, or the bottom hole assembly and transmitting such measurements to the surface for acquisition and analysis. As described above, the MWD tool may include at least one sensor thereon, which may detect properties of the earth formation, the wellbore or the bottom hole assembly (BHA). Such sensors may include, for example, but without limitation, accelerometers, magnetometer, gyroscope, inclinometers, gamma ray sensors, nuclear sensors, resistivity sensors, NMR sensors, etc. Examples of tools incorporating such sensors include TeleScope, ImPulse, SlimPulse, Pathfinder RADAR, Pathfinder MWD, all commercially utilized by Schlumberger. The tool containing the sensor, such as the MWD tool shown in FIG. 1, may be positioned in the well along the drill string (and often near the bit). A wellbore fluid (such as the type described below) may be circulated through the drill string (being jetted into the annulus through nozzles in the drill bit) and into the annular region between the wellbore walls and the drill string. The sensors may take a measurement and transmit a signal to the modulator of the downhole tool so that a signal may subsequently be transmitted from downhole to the surface. Such data signals transmitted from the modulator to the surface may be transmitted through mud pulse telemetry, as described above, or using other telemetry means known in the art, including for example, electromagnetic telemetry, microwave telemetry, acoustic telemetry, etc. In the case of mud pulse telemetry, depending on the type of mud pulse telemetry system being used, the signals may be transmitted in the form of mud pressure pulses through the drill string. Embodiments disclosed herein provide a measurable pressure pulse of at least about 1 psi at the surface, or within the range of about 1 to 5 psi at the surface.

As mentioned above, pressure pulses experienced with conventional oil-based fluids are generally substantially lower than the desirable range of at least 1 psi, often in the range of 0.1 to 0.2 psi due to attenuation of the signal from the modulator to the surface. This is particularly an issue when drilling at large depths, which further increases attenuation. However, the present inventors have found that signal attenuation may be substantially decreased (and thus increasing signal strength) when the medium (or fluid) through which the signal is transmitted is selected in conjunction with the well plan, the drill string, and MWD tool design. Specifically, a rheological profile for the fluid may be designed and/or selected based on the depth of the well, downhole temperature, pipe diameter, and fluid density, all of which effect signal attenuation. As used herein, "rheological profile" means the measured values obtained at 600 revolutions per minute (rpm), 300 rpm, 6 rpm, and 3 rpm at 120° F. using a FANN 35 viscometer. Signal strength may be increased by decreasing the gap in between the rotor and stator through which the fluid flows and/or reducing the rheological profile of the fluid, and particularly the low end rheology, as the fluid serves as the communication medium for the pulsing signal. In accordance with embodiments of the present disclosure, the fluids may possess a high shear viscosity of less than 60 at 600 rpm, and less than 40 at 300 rpm); and a low shear viscosity of less than 5 at 6 and 3 rpm, and less than 4 or 3 at 6 and 3 rpm in particular embodiments. In one or more other embodiments, if the MWD tool being used has a smaller gap, a slightly more viscous fluid may be used and adequate signal strength may still be observed; however, it may also be desirable to use a low-viscosity fluid in order to be able to use higher fluid flow rates while still minimizing or avoiding risk of failure of the rotor/stator or other components of the modulator.

As described below, oil-based fluids generally contain solid particulates that are used to increase the density of the fluid (to balance the pressures of the formation); however, the use of the solid particulates, as well as the viscosifiers and dispersants added to ensure suspension of the particulates, result in a higher rheological profile. However, in accordance with the present disclosure, the solid particulates may selected based on the rheological profile that they impart on the fluid. That is, in one or more embodiments, if a mid-range low shear viscosity (values of up to 8 at 6 and 3 rpm) is desired, a mid-range corresponding particle size distribution may be selected for the fluid. If a lower low shear (or high shear) viscosity, such as those described above, is desired, a lower range particle size distribution may instead be used. Further, in conjunction with the selection of the fluid based on its rheological profile, aspects of the MWD tool, including the gap width between the rotor and stator, internal diameter, rotor configuration, etc. Thus, in conjunction with the well plan, the BHA and fluid may be designed in parallel (or in series if other considerations necessitate certain properties be met). That is, the fluid selection may be based, in part, on the rheological profile of the fluid that will give a signal strength of at least 1 psi. If a greater than needed signal strength (i.e., greater than 2 psi) is predicted (given the well plan, pipe diameter, etc.) expected, the gap between the rotor and stator may be increased. Gaps generally range from 0 to 0.30 inches; as the gap is reduced, greater limitations (due to potential failure risks, including erosion, axial loading and excessive torque on the MWD tool) on fluid flow and density exist. Thus, depending on the predicted signal strength for a fluid, a tool with a greater gap between the rotor and stator and/or a high flow rotor configuration may be selected (depending on desired fluid flow rates). Once the well, BHA, and fluid are planned, drilling may commence (or continue) by circulating the fluid through the drill string and rotor/stator, and upon collection of measurements from the at least one sensor, a signal may be transmitted from the sensor to a modulator in operable communication with the sensor, and then the modulator may transmit a signal (such as through a pressure pulse) through the fluid to the surface. At the surface, the data transmitted by the signal may be collected, filtered, and analyzed according to known techniques.

Oil-Based Fluids

As stated above, in some embodiments the fluid through which the signal is transmitted is an oil-based fluid, such that at least 95% by volume of the fluid is an oil-based fluid. In other words, less than 5% by volume of the carrier fluid is a non-oleaginous fluid. In such embodiments, the oleaginous fluid is selected from the group including mineral oil; a synthetic oil, such as hydrogenated and unhydrogenated olefins including polyalpha olefins, linear and branch olefins and the like, polydiorganosiloxanes, siloxanes, or organosiloxanes, esters of fatty acids, specifically straight chain, branched and cyclical alkyl ethers of fatty acids, mixtures thereof and similar compounds known to one of skill in the art; and mixtures thereof.

In cases where the oleaginous fluid is substantially oil-based, a viscosifier may also be included. The viscosifier will maintain low rheological properties, and prevent settling of the weight material during both drilling operations. Illustrative viscosifiers include organophilic clays, amine treated clays, oil soluble polymers, polyamide resins, polyolefin amides, polycarboxylic acids, and soaps. The amount of viscosifier used in the composition can vary upon the application. However, a concentration of about 0.1% to 6% by weight range is sufficient for most applications. VERSAPAC® is an organic polymer distributed by M-I SWACO, Houston, Tex.; VG69™ and VG-PLUS™ are organoclay materials distributed by M-I SWACO, Houston, Tex.; and VERSA-HRP™ is a polyamide resin material manufactured and distributed by M-I SWACO, that may be used in the fluids disclosed herein.

Invert Emulsion Fluids

As discussed above, the methods of the present disclosure may also use an invert emulsion fluids through which the signal is transmitted, where the invert emulsion fluids may have an oleaginous-to-non-oleaginous ratio of 90:10 to 30:70.

The oleaginous fluid may be a liquid and more preferably is a natural or synthetic oil and more preferably the oleaginous fluid is selected from the group including diesel oil; mineral oil; a synthetic oil, such as hydrogenated and unhydrogenated olefins including polyalpha olefins, linear and branch olefins and the like, polydiorganosiloxanes, siloxanes, or organosiloxanes, esters of fatty acids, specifically straight chain, branched and cyclical alkyl ethers of fatty acids, mixtures thereof and similar compounds known to one of skill in the art; and mixtures thereof. In a particular embodiment, the fluids may be formulated using diesel oil or a synthetic oil as the external phase. The oleaginous fluid in one embodiment may include at least 30% by volume of a material selected from the group including esters, ethers, acetals, dialkylcarbonates, hydrocarbons, and combinations thereof.

The non-oleaginous fluid used in the formulation of the invert emulsion fluid disclosed herein is a liquid and preferably is an aqueous liquid. More preferably, the non-oleaginous liquid may be selected from the group including sea water, a brine containing organic and/or inorganic dissolved salts, liquids containing water-miscible organic compounds and combinations thereof. For example, the aqueous fluid may be formulated with mixtures of desired salts in fresh water. Such salts may include, but are not limited to alkali metal chlorides, hydroxides, or carboxylates, for example. In various embodiments of the drilling fluid disclosed herein, the brine may include seawater, aqueous solutions wherein the salt concentration is less than that of sea water, or aqueous solutions wherein the salt concentration is greater than that of sea water. Salts that may be found in seawater include, but are not limited to, sodium, calcium, aluminum, magnesium, potassium, strontium, and lithium, salts of chlorides, bromides, carbonates, iodides, chlorates, bromates, formates, nitrates, oxides, phosphates, sulfates, silicates, and fluorides. Salts that may be incorporated in a given brine include any one or more of those present in natural seawater or any other organic or inorganic dissolved salts. Additionally, brines that may be used in the drilling fluids disclosed herein may be natural or synthetic, with synthetic brines tending to be much simpler in constitution. In one embodiment, the density of the drilling fluid may be controlled by increasing the salt concentration in the brine (up to saturation). In a particular embodiment, a brine may include halide or carboxylate salts of mono- or divalent cations of metals, such as cesium, potassium, calcium, zinc, and/or sodium.

Oil-in-water emulsions are typically stabilized by both electrostatic stabilization (electric double layer between the two phases) and steric stabilization (van der Waals repulsive forces), whereas invert emulsions (water-in-oil) are typically stabilized by only steric stabilization. Because only one mechanism can be used to stabilize an invert emulsion, invert emulsions are generally more difficult to stabilize, particularly at higher levels of the internal phase, and often experience highly viscous fluids.

Invert emulsion fluids of the present disclosure may have OWR ranging from 70:30 to 10:90, depending on the completion technique and the conditions of the wellbore. In cases where the invert emulsion fluid is a HIPR emulsion with an OWR of less than 50/50, the invert emulsion fluid is stabilized by an emulsifying agent without significant increases in viscosity, as described, for example in U.S. Patent Publication No. 2012/0186880, which is assigned to the present assignee and herein incorporate by reference in its entirety. Additionally, by virtue of the greater internal phase concentration, weight may be provided to the fluid partly through the inherent weight of the aqueous or other internal phase, thus minimizing the need for external agents to increase the density of the fluid.

Weighting Agents

It is recognized that as the fluid density increased from solid particulate agents, also referred to as weighting agents, so too did the volume and mass of weighting agent material required to densify the fluid to control subsurface wellbore pressures. A critical issue with conventionally sized weighting agents is their propensity to settle and separate from the fluid, which can lead directly to fluid influxes and wellbore instability that increases the risk of wellbore failure. Increasing fluid viscosity to mitigate against barite settlement and sag is one approach, but higher fluid viscosities compromise equivalent circulating densities and signal strength.

The particulate weighting agents may be of any particle size (and particle size distribution). In one embodiment the particulate weighting agent may have a $D_{90}$ less than about 70 micrometers. In a more particular embodiment the particulate weighting agent may have a $D_{90}$ less than about 35 micrometers, or less than about 25 or 20 micrometers in yet other embodiments. Some embodiments may include particulate weighting agents having a smaller particle size range than API grade weighing agents, which may generally be referred to as micronized weighting agents. Such weighting agents may generally be in the micron (or smaller) range, including submicron particles in the nanosized range. The small particle size of micronized weighting agents enables low rheology non-aqueous fluids to be formulated with considerably reduced risk of sag and settlement compared to fluids formulated with API drilling grade barite of 75 microns. Further, in one or more embodiments, such size ranges may result in a fluid having the viscosity profiles described above. In one or more embodiments, a particle size distribution having a $D_{90}$ of less than about 35 micrometers and a $D_{50}$ of less than 25 micrometers may be used as a "mid-range" distribution when a similar mid-range low shear viscosity of less than 8 at 6 and 3 rpm (measured using a Fann 35 Viscometer from Fann Instrument Company (Houston, Tex.) at 120 F) is desired. Further, in one or more other embodiments, a particle size distribution having a $D_{90}$ of less than about 20 micrometer (or less than 15 micrometers in more particular embodiments) and a $D_{50}$ of less than 10 micrometers (or less than 5 micrometers in more particular embodiments) may be used as a "low end-range" distribution when a low-range low shear viscosity of less than 5 at 6 and 3 rpm (measured using a Fann 35 Viscometer from Fann Instrument Company (Houston, Tex.) at 120 F) is desired.

In some embodiments, the average particle size (d50, the size at which 50% of the particles are smaller) of the weighting agents may range from a lower limit of greater than 5 nm, 10 nm, 30 nm, 50 nm, 100 nm, 200 nm, 500 nm, 700 nm, 0.5 micron, 1 micron, 1.2 microns, 1.5 microns, 3 microns, 5 microns, or 7.5 microns to an upper limit of less than 500 nm, 700 microns, 1 micron, 3 microns, 5 microns, 10 microns, 15 microns, 20 microns, where the particles may range from any lower limit to any upper limit. In other embodiments, the d90 (the size at which 90% of the particles are smaller) of the weighting agents may range from a lower limit of greater than 20 nm, 50 nm, 100 nm, 200 nm, 500 nm, 700 nm, 1 micron, 1.2 microns, 1.5 microns, 2 microns, 3 microns, 5 microns, 10 microns, or 15 microns to an upper limit of less than 30 microns, 25 microns, 20 microns, 15 microns, 10 microns, 8 microns, 5 microns, 2.5 microns, 1.5 microns, 1 micron, 700 nm, 500 nm, where the particles may range from any lower limit to any upper limit. The above described particle ranges may be achieved by grinding down the materials to the desired particle size or by precipitation of the material from a bottoms up assembly approach. Precipitation of such materials is described in U.S. Pat. No. 2010/009874, which is assigned to the present assignee and herein incorporated by reference. One of ordinary skill in the art would recognize that, depending on the sizing technique, the weighting agent may have a particle size distribution other than a monomodal distribution. That is, the weighting agent may have a particle size distribution that, in various embodiments, may be monomodal, which may or may not be Gaussian, bimodal, or polymodal.

In one or more embodiments, the weighting agent may be coated or uncoated, and may be sized to have a $d_{50}$ less than 25 microns, and more preferably a $d_{50}$ less than 10 microns. In some embodiments, the weighting agents include dispersed solid colloidal particles with a weight average particle diameter (d50) of less than 10 microns that are coated with a hydrophilic, polymeric deflocculating agent or dispersing agent. In other embodiments, the weighting agents include dispersed solid colloidal particles with a weight average particle diameter (d50) of less than 8 microns that are coated with a polymeric deflocculating agent or dispersing agent; less than 6 microns in other embodiments; less than 4 microns in other embodiments; and less than 2 microns in yet other embodiments. The fine particle size will generate suspensions or slurries that will show a reduced tendency to sediment or sag, and the polymeric dispersing agent on the surface of the particle may control the inter-particle interactions and thus will produce lower rheological profiles. It is the combination of fine particle size and control of colloidal interactions that reconciles the two objectives of lower viscosity, which in turn allows for increased signal strength to be achieved.

Weighting agents or density materials (other than the inherent weight provided by the internal aqueous phase) suitable for use the fluids disclosed herein may include at least one of barite, galena, hematite, magnetite, iron oxides, illmenite, siderite, celestite, dolomite, calcite, titanium oxide, iron-titanium oxide, cassiterite, lead sulfide, pyrite, ferro silicon, and the like. The quantity of such material added, if any, depends upon the desired density of the final composition. Typically, weighting material may be added to result in a fluid density of up to about 24 pounds per gallon (but up to 21 pounds per gallon or up to 19 pounds per gallon in other particular embodiments). Additionally, it is also within the scope of the present disclosure that the fluid may be at least partially weighted up using salts (such as in the non-oleaginous fluid discussed above), but having solid weighting agents therein as well. One having ordinary skill in the art would recognize that selection of a particular material may depend largely on the density of the material as typically, the lowest wellbore fluid viscosity at any particular density is obtained by using the highest density particles.

Coated weighting agents may be formed by grinding a solid particulate material and polymeric dispersing agent so that the dispersing agent is absorbed to the surface of the resulting solid particles. The grinding may be carried out in the presence of either an oleaginous base fluid or a non-oleaginous base fluid. Where the grinding is carried out in the presence of an oleaginous fluid, the polymeric dispersing agent is selected from oleic acid, polybasic fatty acids, alkylbenezen sulfonic acids, alkane sulfonic acids, linear alpha-olefin sulfonic acids, or the alkaline earth metal salts of any of the above acids, phospholipids, and a polyacrylate ester made from at least one of the following monomers: stearyl methacrylate, butylacrylate, and acrylic acid. One skilled in the art would recognize that other acrylate or other unsaturated carboxylic acid monomers (or esters thereof) may be used to achieve substantially the same results as disclosed herein. Where the solid is dispersed into a non-oleaginous base fluid, the polymeric dispersing agent may be a water soluble polymer that is a homopolymer or copolymer of monomers selected from the group consisting of acrylic acid, itaconic acid, maleic acid or anhydride, hydroxypropyl acrylate vinylsulphonic acid, acrylamido 2-propane sulphonic acid, acrylamide, styrene sulphonic acid, acrylic phosphate esters, methyl vinyl ether and vinyl acetate, wherein the acid monomers may also be neutralized to a salt.

Weighting agents may also be coated through a dry process, where the weighting agent is dry blended with a polymeric dispersing agent, as discussed in U.S. Ser. No. 11/741,199, which is assigned to the present assignee and is hereby incorporated by reference. The polymeric dispersing agent for the dry blending process may be selected from the group consisting of polyacrylate esters, oleic acid, polybasic fatty acids, alkylbenzene sulfonic acids, alkane sulfonic acids, linear alpha olefins sulfonic acid, alkaline earth metal salts of any of the above acids, phospholipids, and combinations thereof.

Weighting agents may also be formed by chemical precipitation, as discussed in U.S. application Ser. No. 12/440,706, which is assigned to the present assignee and is hereby incorporated by reference. The precipitation occurs following the mixing of at least two chemical species in a solution. The chemical identity of those chemicals mixed will depend on the desired resulting compound to be sued as a weighting agent. For example, when a barium sulfate weighting agent is desired, a barium sulfate salt solution may be mixed with an alkali sulfate salt solution. Alternatively, where calcium carbonate is desired, a calcium hydroxide solution combined with carbon dioxide results in the formation of calcium carbonate. Where a coating is desired, the precipitation may be conducted in the presence of a dispersant or wetting agent, or the coating can be applied after precipitation.

In embodiments disclosed herein, the wellbore fluid may have a density of greater than about 8.0 pounds per gallon (ppg), or at least 10, 12, or 14 ppg in other embodiments. In yet another embodiment, the density of the wellbore fluid in some embodiments ranges from about 6 to about 18 ppg, where the weighting agent is added in an amount to increase the density of the base fluid by at least 1 ppg or by at least 2, 4, or 6 ppg in other embodiments.

Other Additives

Other additives that may be included in the wellbore fluids disclosed herein include for example, wetting agents, organophilic clays, viscosifiers, surfactants, dispersants, interfacial tension reducers, pH buffers, mutual solvents, thinners, thinning agents and cleaning agents. The addition of such agents should be well known to one of ordinary skill in the art of formulating drilling fluids and muds.

Wetting agents that may be suitable for use in the fluids disclosed herein include crude tall oil, oxidized crude tall oil, surfactants, organic phosphate esters, modified imidazolines and amidoamines, alkyl aromatic sulfates and sulfonates, and the like, and combinations or derivatives of these. However, when used with the invert emulsion fluid, the use of fatty acid wetting agents should be minimized so as to not adversely affect the reversibility of the invert emulsion disclosed herein. FAZE-WET™, VERSA-COAT™, SUREWET™, VERSAWET™, and VERSAWET™ NS are examples of commercially available wetting agents manufactured and distributed by M-I L.L.C. that may be used in the fluids disclosed herein. Silwet L-77, L-7001, L7605, and L-7622 are examples of commercially available surfactants and wetting agents manufactured and distributed by General Electric Company (Wilton, Conn.).

As discussed above, viscosifying agents that may be used in the fluids disclosed herein include organophilic clays, amine treated clays, oil soluble polymers, polyamide resins, polycarboxylic acids, and soaps, particularly during gravel packing by the alternate path technique (viscous fluid packing) The amount of viscosifier used in the composition can vary upon the end use of the composition. However, normally about 0.1% to 6% by weight range is sufficient for most applications. VG69™ and VG-PLUS™ are organoclay materials distributed by M-I SWACO, Houston, Tex., and VERSA-HRP™ is a polyamide resin material manufactured and distributed by M-I SWACO, that may be used in the fluids disclosed herein. While such viscosifiers may be particularly useful during viscous fluid packing, they viscosifiers may also be incorporated into the fluid formulation for other completion operations as well.

Conventional methods can be used to prepare the drilling fluids disclosed herein in a manner analogous to those normally used, to prepare conventional oil-based drilling fluids. In one embodiment, a desired quantity of oleaginous fluid such as a base oil and a suitable amount of a surfactant are mixed together and the remaining components are added sequentially with continuous mixing. An invert emulsion may also be formed by vigorously agitating, mixing or shearing the oleaginous fluid and the non-oleaginous fluid.

The fluids disclosed herein are especially useful in the drilling, completion and working over of subterranean oil and gas wells, where the fluid serves as a communication medium through which a data signal is being transmitted. Such muds and fluids are especially useful in the drilling of HPHT, deep, or high inclination wells, in which MWD signals are often more attenuated.

EXAMPLE

Example 1

The following example was used to test the improvement in signal strength of the oilfield tool, such as that described in the present disclosure.

A field trial with an oil-based fluid comprising micronized barite was carried out in the 8½-in interval on a well. The main objective for this trial was to demonstrate the benefits of using an oil-based fluid comprising a micronized weighting agent (available commercially from M-I SWACO under the trade name OB WARP) at approximately 15.7 ppg as compared to a conventional oil-based fluid comprising a conventionally-sized (API) weighting agent at approximately 11.3 ppg.

According to the pressure prognosis the 8½ section had narrow operating window. The maximum equivalent circulating density could not exceed 0.5 ppg above the surface drilling fluid density with a flow rate of 350 gpm (since ESD downhole was not used). The possibility of fracturing the formation, hence loss circulation, made it critical to optimize the fluid performance.

A fluid having the rheology profile detailed in Table 1 was provided.

TABLE 1

| Fluid Rheology | | | | |
|---|---|---|---|---|
| Sample From | Flow Line 15:00 | Flow Line 15:00 | Flow Line 15:00 | Flow Line 9:30 |
| FlowLine Temp | 100 | 100 | 100 | 98 |
| Depth/TVD | 4571/4571 | 4571/4571 | 4571/4571 | 4564/4564 |
| Fluid Weight | 15.7@100 | 15.7@100 | 15.7@100 | 15.7@100 |
| Funnel Viscosity | 50 | 50 | 50 | 51 |
| Rheology Temp | 120 | 150 | 180 | 120 |
| R600/R300 | 43/25 | 33/19 | 27/16 | 42/24 |
| R200/R100 | 18/11 | 14/9 | 12/8 | 17/11 |
| R6/R3 | 4/3 | 3/2 | 3/2 | 4/3 |
| PV | 18 | 14 | 11 | 18 |
| YP | 7 | 5 | 5 | 6 |

TABLE 1-continued

| Fluid Rheology | | | | |
|---|---|---|---|---|
| Sample From | Flow Line 15:00 | Flow Line 15:00 | Flow Line 15:00 | Flow Line 9:30 |
| 10 s/10 m Gel | 4/6 | 3/5 | 3/4 | 4/6 |
| HTHP Fluid Loss | 4 | — | — | 4 |
| Unc Ret Solids | 33 | — | — | 33 |
| Oil/Water Ratio | 86/14 | — | — | 86/14 |
| Alkal Mud (Pom) | 3 | — | — | 3 |
| $Cl^-$ Whole Mud | 19000 | — | — | 20000 |
| Emul Stability | 668 | 585 | 584 | 531 |

The recorded log of the signal strength is shown in FIGS. 5-7. As shown in FIG. 5, the signal strength of received through the conventional oil-based drilling fluid was on the order of 0.1-0.2 psi. Displacement of the conventional fluid with an oil-based fluid containing micronized weighting agent is illustrated as beginning in the log shown in FIG. 6, and continuing onto FIG. 7, which also shows completion of displacement. As illustrated in FIGS. 5-7, by displacing the conventional drilling fluid with an oil-based fluid having a micronized weighting agent, the signal pressure transducer at the surface was able to recognize a ten-fold increase in signal strength from 0.1-0.2 psi to 1-2 psi. Adding to that, as shown in FIG. 8, 50% torque reduction was recorded and weighting agent sag was not an issue. These performance characteristics make the oil-based fluid with micronized weighting agents a viable candidate for drilling high inclined wellbores and other critical wells.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A method of measuring a property of an earth formation and transmitting information through the earth formation comprising:

positioning at least one sensor downhole;

circulating a wellbore fluid downhole, wherein the wellbore fluid has a viscometer reading of less than 5, measured at 6 and 3 rpm and comprises a base fluid and a weighting agent having a $d_{50}$ less than 25 microns; and transmitting a first signal from the at least one sensor to at least one modulator in operable communication with the at least one sensor.

2. The method of claim 1, further comprising:

transmitting a second signal from the modulator through the wellbore fluid to a surface.

3. The method of claim 2, wherein the second signal is transmitted through pressure pulse telemetry.

4. The method of claim 3, wherein the pressure pulse telemetry includes one of positive pressure pulse, negative pressure pulse, and continuous pulse.

5. The method of claim 3, wherein the pressure at the surface is within the range of about 1 psi to about 5 psi.

6. The method of claim 1, wherein the wellbore fluid has a viscometer reading of less than 60, measured at 600 rpm.

7. The method of claim 1, wherein the wellbore fluid has a viscometer reading of less than 40, measured at 300 rpm.

8. The method of claim 2, wherein the signal strength of the second signal is at least double the strength when compared to the signal strength achieved with a wellbore fluid comprising a base fluid and a weighting agent having a d50 greater than 25 microns.

9. The method of claim 1, wherein the weighting agent is selected from the group consisting of barium sulfate, calcium carbonate, dolomite, ilmenite, hematite, olivine, siderite, strontium sulfate, manganese oxide, titanium oxide, iron-titanium oxide, cassiterite, lead sulfide, pyrite, ferro silicon, and combinations thereof.

10. The method of claim 1, wherein the weighting agent has a d50 less than 10 microns.

11. The method of claim 1, wherein the weighting agent is coated with a dispersant.

12. A method of designing a drilling system, comprising:

selecting a fluid system to have a viscometer reading of less than 8, measured at 6 and 3 rpm;

selecting a MWD tool and a gap between a rotor and stator, wherein one of the selection of the fluid system and the selection of the MWD tool and the gap is made based upon the selection of the other;

assembling a drilling system with the selected MWD and gap; and circulating the selected fluid system through the drilling system while drilling a wellbore through an earth formation.

13. The method of claim 12, wherein the gap ranges from 0 to about 0.30 inches.

14. The method of claim 12, wherein during the selecting, the viscometer reading is lowered to accommodate a greater gap.

15. The method of claim 12, wherein the fluid system has a viscometer reading of less than 5, measured at 6 and 3 rpm.

16. The method of claim 12, wherein the wellbore fluid has a viscometer reading of less than 60, measured at 600 rpm.

17. The method of claim 12, wherein the wellbore fluid has a viscometer reading of less than 40, measured at 300 rpm.

18. The method of claim 12, wherein the selecting the fluid system is based on depth of the well, downhole temperature, pipe diameter, and/or fluid density.

19. The method of claim 12, wherein the selecting the MWD tool further includes selecting the internal diameter and/or rotor configuration.

20. A downhole measurement while drilling system comprising:

at least one sensor at a drill string locatable downhole during a well operation; and a communication medium at the drill string capable of transmitting sensed data between the sensor and a surface processor, wherein the communication medium has a viscometer reading of less than about 5, measured at 6 and 3 rpm, and comprises a base fluid and a weighting agent having a d50 less than 25 microns.

21. The system of claim 20, further comprising a modulator operably connected to the at least one sensor, for receiving a signal from the sensor and transmitting the sensed data to the surface processor.

22. The system of claim 20, wherein the weighting agent is selected from the group consisting of barium sulfate, calcium carbonate, dolomite, ilmenite, hematite, olivine, siderite, strontium sulfate, manganese oxide, titanium oxide, iron-titanium oxide, cassiterite, lead sulfide, pyrite, ferro silicon, and combinations thereof.

23. The system of claim 20, wherein the weighting agent has a d50 less than 10 microns.

24. The system of claim 20, wherein the weighting agent is coated with a dispersant.

* * * * *